US009566807B2

(12) United States Patent
Takizawa

(10) Patent No.: US 9,566,807 B2
(45) **Date of Patent: *Feb. 14, 2017**

(54) MEDIA CONVEYANCE DEVICE, PRINTER, AND CONTROL METHOD OF A PRINTER

(71) Applicant: Seiko Epson Corporation, Tokyo (JP)

(72) Inventor: Yuki Takizawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/979,926

(22) Filed: Dec. 28, 2015

(65) Prior Publication Data

US 2016/0107461 A1 Apr. 21, 2016

Related U.S. Application Data

(63) Continuation of application No. 14/697,100, filed on Apr. 27, 2015, now Pat. No. 9,238,379.

(30) Foreign Application Priority Data

May 19, 2014 (JP) ..... 2014-103135

(51) Int. Cl.

| | |
|---|---|
| ***B41J 2/01*** | (2006.01) |
| ***B41J 13/00*** | (2006.01) |
| ***B41J 15/16*** | (2006.01) |
| ***B65H 23/16*** | (2006.01) |
| ***B65H 23/185*** | (2006.01) |

(Continued)

(52) U.S. Cl.

CPC ..... *B41J 13/0009* (2013.01); *B41J 15/16* (2013.01); *B41J 15/165* (2013.01); *B65H 16/103* (2013.01); *B65H 20/005* (2013.01); *B65H 20/16* (2013.01); *B65H 23/16* (2013.01); *B65H 23/185* (2013.01); *B65H 23/1825* (2013.01); *B65H 2403/50* (2013.01); *B65H 2403/942* (2013.01); *B65H 2801/12* (2013.01)

(58) Field of Classification Search

None

See application file for complete search history.

(56) References Cited

U.S. PATENT DOCUMENTS

| | | | | |
|---|---|---|---|---|
| 4,838,498 | A * | 6/1989 | Huth | B65H 23/1825 242/420.3 |
| 5,825,374 | A * | 10/1998 | Albertalli | B41J 11/0085 226/156 |
| 9,238,379 | B2 * | 1/2016 | Takizawa | B41J 15/16 |

FOREIGN PATENT DOCUMENTS

| | | |
|---|---|---|
| JP | 2003-252501 A | 9/2003 |
| JP | 2006-150859 A | 6/2006 |

* cited by examiner

*Primary Examiner* — Matthew Luu
*Assistant Examiner* — Tracey McMillion
(74) *Attorney, Agent, or Firm* — Nutter McClennen & Fish LLP; John J. Penny, Jr.

(57) ABSTRACT

A printer takes up slack in media while suppressing excessive rewinding, and can check the movement of a movable member that moves following change in tension on the media. The printer drives the supply motor in a first operating mode in a slack removal operation that rewinds the recording paper (media) onto a paper roll 2, and stops driving the supply motor when the tension lever (movable member) moves from a slack-side first position toward a second position. In the movement checking operation, the supply motor is driven in a second operating mode with greater output than the first operating mode, rewinds the recording paper on the paper roll, and sets the tension lever to the second position.

12 Claims, 6 Drawing Sheets

(51) Int. Cl.

| | |
|---|---|
| ***B65H 16/10*** | (2006.01) |
| ***B65H 23/182*** | (2006.01) |
| ***B65H 20/00*** | (2006.01) |
| ***B65H 20/16*** | (2006.01) |

MEDIA CONVEYANCE DEVICE, PRINTER, AND CONTROL METHOD OF A PRINTER

The present application claims priority under 35 U.S.C. §120 to U.S. patent application Ser. No. 14/697,100, filed on Apr. 27, 2015. The present application also claims priority under 35 U.S.C §119 to Japanese Patent Application No. 2014-103135, filed May 19, 2014, which is hereby incorporated by reference in its entirety.

BACKGROUND

1. Technical Field

The present disclosure relates to a media conveyance device that conveys continuous media delivered from a paper roll, and a drive motor for rotating the paper roll. The invention also relates to a printer having the media conveyance device, and a control method of the printer.

2. Related Art

Printers having a conveyance mechanism that conveys continuous recording paper delivered from a paper roll through a conveyance path past the printing position of a printhead, and a drive motor that rotates the paper roll, are known from the literature. To prevent the tension on the recording paper from fluctuating greatly when recording paper conveyance starts and the conveyance speed becoming unstable in such printers, an initialization step is performed to remove the slack in the recording paper before conveyance starts. In the initialization operation the printer drives the drive motor to rotate the paper roll and take up slack in the recording paper between the conveyance mechanism and the paper roll onto the paper roll.

A rewind device that rewinds recording paper onto a paper roll is described in JP-A-2006-150859. This rewind device includes a drive motor that turns the paper roll; a tension roller that is located between the conveyance mechanism of the printer and the paper roll, and moves between highest and lowest positions tracking change in the tension on the recording paper; a tension spring that urges the tension roller to the lowest position; a sensor that detects the current position of the tension roller; and a rewinding control unit that controls the drive motor based on the current position of the tension roller.

If a configuration equivalent to the mechanism of the rewind device described in JP-A-2006-150859 is included in a printer, the initialization operation that removes slack in the recording paper can be executed by controlling driving the drive motor based on the current position of a movable member (tension roller). By controlling driving the drive motor based on the current position of the movable member to rewind or deliver recording paper during conveyance of the recording paper by the conveyance mechanism, this configuration can suppress fluctuation in the tension (back tension) on the recording paper and can suppress a drop in print quality due to variation in the conveyance speed.

However, problems such as described below occur in the initialization operation when a configuration corresponding to the mechanism described in JP-A-2006-150859 is deployed in a printer.

When there is slack in the recording paper between the conveyance mechanism and the paper roll, there is no tension on the recording paper and the movable member is positioned to a first position at one end of its range of movement, and in this position there is no way to know how much slack is in the recording paper based on the current position of the movable member.

Therefore, when there is minimal slack in the recording paper when operation starts, the recording paper may be rewound excessively onto the paper roll by driving the drive motor, and excessive tension may be applied to the recording paper. As a result, the recording paper may be pulled out of the conveyance mechanism to the paper roll side, resulting in the conveyance mechanism being unable to convey the recording paper.

When the recording paper is rewound too much on the paper roll by driving the drive motor, the movable member moves abruptly to a second position, which is the opposite end of the range of movable member movement as the first position end, and collides with the stop that limits the range of movable member movement on the second position side. This produces noise, including the sound of impact.

To resolve these problems, driving the drive motor in a low output operating mode is conceivable. For example, excessively rewinding the recording paper onto the paper roll can be prevented even when the drive motor is driven when there is little slack by driving the drive motor in an operating mode with output low enough that the movable member cannot reach the second position by the urging force of the urging member.

However, when the drive motor is driven in a low output operating mode, the operation that checks movement of the movable member cannot be executed. More specifically, the initialization operation must confirm that the movable member can move between the first position and the second position to ensure that tension can be controlled normally when controlling driving the drive motor based on the current position of the movable member to suppress fluctuation in the tension on the recording paper during recording paper conveyance. However, because the movable member cannot be moved to the second position in resistance to the urging force of the urging member when the drive motor is driven in a low output operating mode, movement of the movable member cannot be confirmed.

SUMMARY

The invention is directed to solving this problem and provides a media conveyance device that removes slack from media while preventing rewinding the medium excessively on the paper roll and can determine whether or not movement of a movable member that moves according to fluctuation in tension on the medium is obstructed, a printer having the media conveyance device, and a control method of the printer.

To achieve the foregoing objective, a media conveyance device according to another aspect of the invention includes a conveyance mechanism that conveys continuous media delivered from a paper roll through a conveyance path; a drive motor that rotates the paper roll; a movable member disposed to the conveyance path between the paper roll and the conveyance mechanism, and movable between a first position and a second position different from the first position following change in the tension on the media; a urging member that urges the movable member from the second position toward the first position; a position detector that detects the current position of the movable member; and a control unit that drives the drive motor in a first operating mode and rewinds the media onto the paper roll until the movable member moves from the first position to a specific position toward the second position, and drives the drive motor in a second operating mode with greater output than in the first operating mode, rewinds the media onto the paper roll based on the current position of the movable member, and moves the movable member from the specific position to the second position.

In this aspect of the invention, the control unit drives the drive motor in a low output first operating mode, and when the movable member moves from the first position to a specific position toward the second position, stops driving the drive motor in the first operating mode and ends the slack removal operation. Excessively rewinding the media onto the paper roll can be prevented in the operation removing slack in the media between the conveyance mechanism and the paper roll in the initialization operation even when there is little slack in the media. The media being pulled out from the conveyance mechanism to the paper roll side, and the conveyance mechanism becoming unable to convey the media, can therefore be avoided.

In addition, the movable member can be prevented from reaching the second position, colliding with the stop member that limits the range of movement of the movable member on the second position side, and making noise.

The control unit also drives the drive motor in a high output second operating mode. The control unit can therefore move the movable member to the second position in resistance to the urging force of the urging member. Whether or not the movable member can move between the first position and the second position can therefore be checked in the initialization operation.

Because there is zero slack in the media between the paper roll and the conveyance mechanism when the movable member is driven in the second operating mode, the current position of the movable member and the amount of media rewound by driving the drive motor match. Therefore by driving the drive motor based on the current position, the movable member can be accurately set to the second position, and collision between the movable member and the stop member can be prevented.

In a media conveyance device according to another aspect of the invention, the urging member does not move the movable member to the second position in resistance to the urging force when the drive motor is driven in the first operating mode.

Thus comprised, collision between the movable member and the stop that limits the range of movable member movement to the second position side and noise resulting therefrom in the media rewind operation can be reliably prevented.

In a media conveyance device according to another aspect of the invention, the control unit, after executing at least once a target positioning operation that sets a position between the current position of the movable member and the second position as a first target position, drives the drive motor in the first operating mode based on the first target position and the current position of the movable member, and moves the movable member to the first target position, sets the second position as a second target position, drives the drive motor in the first operating mode based on the second target position and the current position of the movable member, and sets the movable member to the second target position.

Thus comprised, because the movable member is moved in steps while changing the target position in the movement checking operation of the movable member, the speed of movable member movement can be suppressed even when driving the drive motor in the high output operating mode. The movable member can therefore be reliably set to the second position, and noise resulting from contact between the movable member and the stop can be prevented. Furthermore, because the speed of movable member movement can be suppressed, the media can be prevented from becoming stuck between the stop member and the movable member moving to the second position side.

In another aspect of the invention, to move the movable member to the target position by driving the drive motor and rewinding the roll paper, the control unit PID controls the drive motor based on the difference between the current position and the first or second target position.

In a media conveyance device according to another aspect of the invention, the control unit sets a predetermined position between the first position and the second position as the slack removal target position, and based on the slack removal target position and the current position of the movable member, drives the drive motor in the first operating mode and moves the movable member from the first position.

Thus comprised, the drive motor can be driven with the target position of the slack removal operation set to the second position side of a specific position that the movable member can reach. As a result, the movable member can be moved in resistance to the urging force of the urging member from the first position to a specific position toward the second position when the drive motor is driven in a first operating mode with relatively low output power to turn the paper roll with PID control, for example.

In a media conveyance device according to another aspect of the invention, when the movable member reaches the second position, the control unit sets a predetermined reference position between the first position and the second position as the target position, and drives the drive motor in the second operating mode based on the target position and the current position, causing the media to go slack and set the movable member to the target position.

Thus comprised, when the conveyance operation continues from the initialization operation, control suppressing change in the tension on the media can start without delay. More specifically, because the movable member is set to the reference position when the initialization operation ends, driving the drive motor can be controlled based on the current position of the movable member and the reference position in the conveyance operation, the paper roll can be turned and the media rewound or delivered, and change in the tension on the media can be suppressed.

In a printer according to another aspect of the invention, the conveyance mechanism includes a conveyance belt, and a roller that is pushed to the conveyance belt and holds the media between the conveyance belt and the roller.

Further preferably, the printer according to the invention has the media conveyance device described above, and a printhead. The conveyance mechanism conveys the media through a conveyance path passing the print position of the printhead.

Thus comprised, an initialization operation that includes removing slack in the recording paper while suppressing rewinding the media to the paper roll too much, and checking whether or not movement of a movable member that moves following variation in the tension on the media is obstructed, can be executed before the printing process. Therefore, when the conveyance operation starts, the tension on the recording paper or other media varying greatly and the conveyance speed becoming unstable can be prevented. In addition, normal execution of control that drives the drive motor based on the current position of the movable member during the printing process and suppresses fluctuation in the tension on the media can be assured.

Another aspect of the invention is a control method of a printer including a conveyance mechanism that conveys continuous media delivered from a paper roll through a conveyance path, a drive motor that rotates the paper roll, a movable member disposed between the paper roll and the conveyance mechanism and able to move following change in the tension on the media, including steps of: urging the movable member toward a first position from the side of a second position different from the first position; driving the drive motor in a first operating mode to rewind the media onto the paper roll until the movable member moves from the first position to a specific position toward the second position; and driving the drive motor in a second operating mode with greater output than in the first operating mode, rewinding the media onto the paper roll based on the current position, and moving the movable member from the specific position to the second position.

In the slack removal process in this aspect of the invention, the drive motor is driven in a low output first operating mode, an driving the drive motor in the first operating mode stops and slack removal ends when the movable member moves from the first position to a specific position toward the second position. Excessively rewinding the media onto the paper roll can therefore be prevented in the operation removing slack in the media between the conveyance mechanism and the paper roll in the initialization operation even when there is little slack in the media. Furthermore, because the drive motor is driven in the high output second operating mode in the movement checking operation, whether or not movement by the urging force of the urging member throughout the movement range defined by the first position and the second position is possible can be checked. Because there is zero slack in the media between the paper roll and the conveyance mechanism when the movement checking operation starts, the current position of the movable member and the amount of slack in the media taken up by driving the drive motor match. Therefore, by driving the drive motor based on the current position in the movement checking operation, the movable member can be reliably set to the second position, and collision between the movable member and the stop can be prevented.

In a control method of a printer according to another aspect of the invention, the urging member does not move the movable member to the second position in resistance to the urging force when the drive motor is driven in the first operating mode.

Thus comprised, collision between the movable member and the stop that limits the range of movable member movement to the second position side and noise resulting therefrom in the media rewind operation can be reliably prevented.

Further preferably, the control method of the printer also includes: setting a position between the current position of the movable member and the second position as a first target position, executing a target positioning operation at least once, the target positioning operation driving the drive motor based on the first target position and the current position of the movable member, and moving the movable member to the first target position, and then setting the second position as a second target position, driving the drive motor based on the second target position and the current position, and setting the movable member to the second target position.

Thus comprised, because the movable member is moved in steps in the movement checking operation, the speed of movement can be suppressed. Collision between the movable member and the stop can therefore be prevented. In addition, because the speed of movable member movement can be suppressed, the media can be prevented from becoming stuck between the movable member and the stop at the second position.

To move the movable member to the target position by driving the drive motor and rewinding the media onto the paper roll, the drive motor is controlled by PID control based on the difference between the current position and the first or second target position.

Further preferably, a control method of the printer according to another aspect of the invention also includes setting a predetermined position between the first position and the second position as the target position, and based on the target position and the current position, driving the drive motor and moving the movable member from the first position.

Thus comprised, the target position can be set closer to the second position than a position to which the movable member is actually moved when removing slack, and the drive motor driven. Therefore, when driving the drive motor in a relatively low output first operating mode to turn the paper roll by PID control, for example, the movable member can be moved to a specific position toward the second position from the first position in resistance to the urging force of the urging member.

A control method of a printer according to another aspect of the invention further includes: after moving the movable member from the specific position to the second position, setting a reference position previously set between the first position and the second position as the target position, and driving the drive motor in the second operating mode based on the target position and the current position, causing the media to go slack and the movable member to move to the target position.

Thus comprised, control suppressing change in the tension on the media can be started without delay when, for example, the conveyance operation proceeds continuously from the initialization operation. More specifically, because the movable member is at the reference position when the initialization operation ends, driving the drive motor can be controlled based on the reference position and the current position of the movable member, the paper roll can be turned to rewind or deliver media appropriately, and change in the tension on the media can be suppressed.

Other objects and attainments together with a fuller understanding of the invention will become apparent and appreciated by referring to the following description and claims taken in conjunction with the accompanying drawings.

DESCRIPTION OF EMBODIMENTS

Some embodiments of a printer according to the present invention are described below with reference to the accompanying figures.

Figure 1:
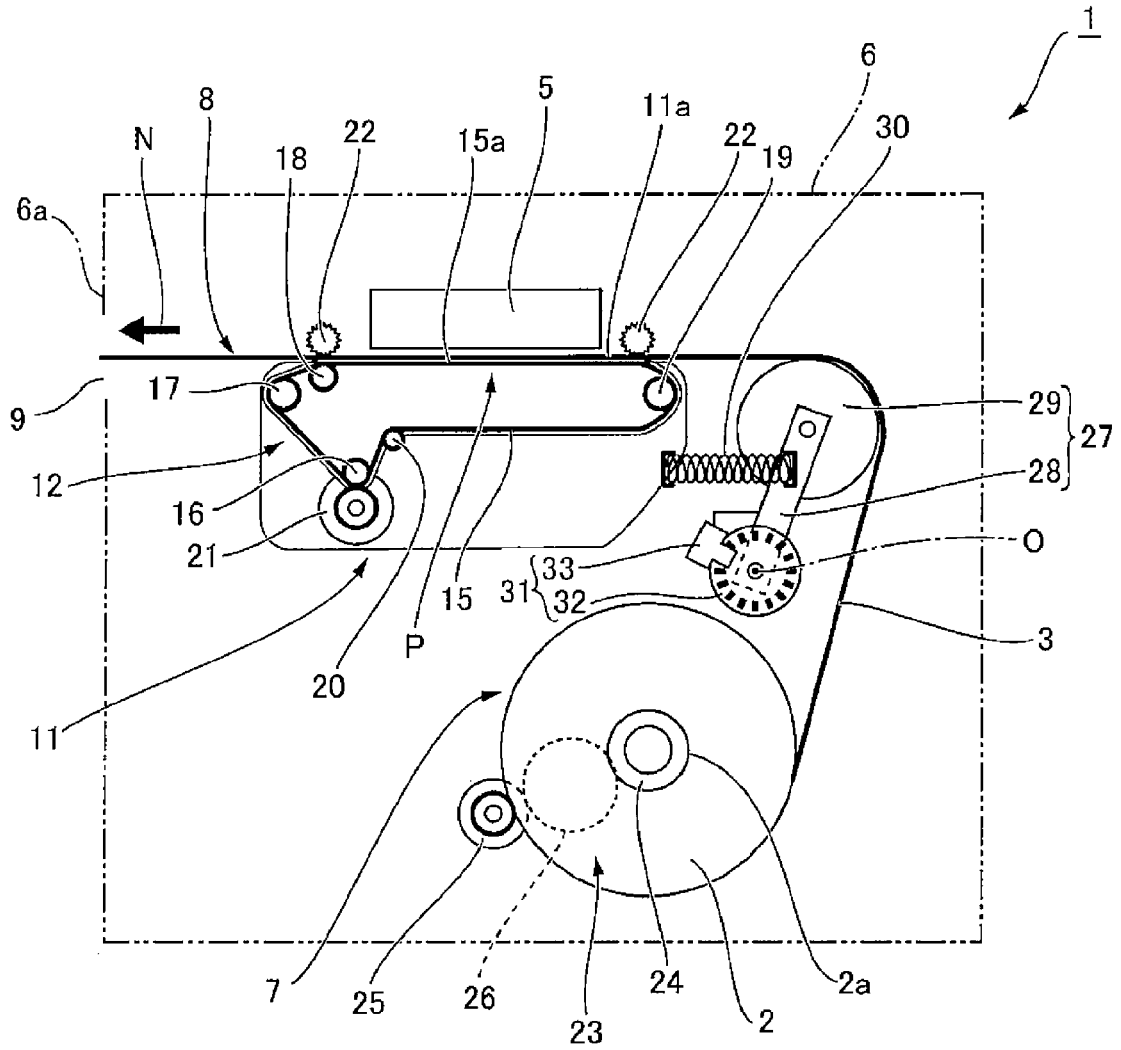
FIG. 1 illustrates the basic configuration of a printer according to the invention.
Figure 2:
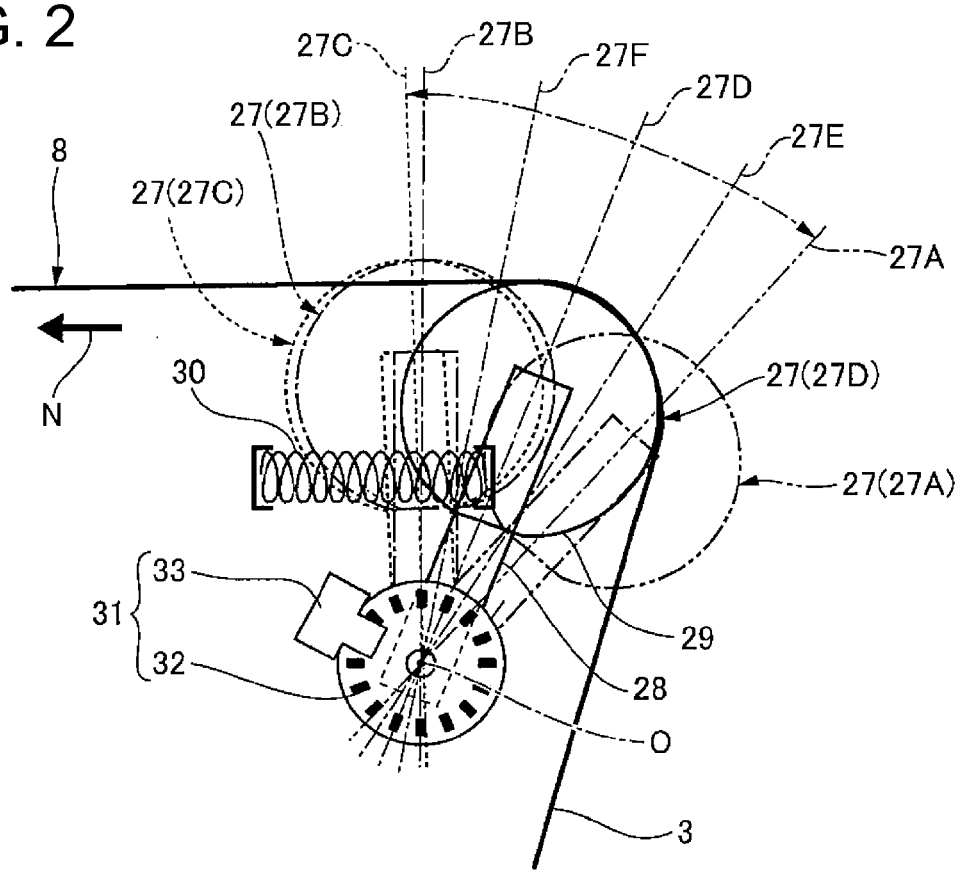
FIG. 2 illustrates the movement range of the tension lever.

FIG. 1 illustrates the basic configuration of a printer according to the invention. FIG. 2 illustrates the movement range of the tension lever. A printer 1 according to the invention is a roll paper printer that prints on continuous recording paper (media) that is wound into a paper roll 2 and is delivered from the paper roll 2 to the conveyance path. The printer 1 in this example is a line printer having an inkjet line head as the printhead 5.

As shown in FIG. 1, the printer 1 has a roll paper compartment 7 that holds the paper roll 2, and a conveyance path 8 for conveying the recording paper 3 pulled from the paper roll 2, inside the printer case 6 indicated by an imaginary line. The conveyance path 8 goes from the roll paper compartment 7, past the print position P of the printhead 5, and to the paper exit 9 disposed at the top part of the front 6*a* of the printer case 6. The printhead 5 is disposed above the roll paper compartment 7.

A platen unit 11 is disposed below the printhead 5. The platen unit 11 has a platen surface 11*a* opposite the printhead 5 with a specific gap therebetween. The print position P is determined by the platen surface 11*a*. A conveyance mechanism 12 for conveying the recording paper 3 through the conveyance path 8 is also disposed to the platen unit 11.

The conveyance mechanism 12 includes an endless conveyance belt 15, a belt drive roller 16 on which the conveyance belt 15 is mounted, and a plurality of guide rollers 17 to 20. The conveyance mechanism 12 also includes a conveyance motor 21 as the drive source. Drive power from the conveyance motor 21 is transferred to the belt drive roller 16, and the conveyance belt 15 turns as a result of rotationally driving the belt drive roller 16. The conveyance mechanism 12 conveys the recording paper 3 from the roll paper compartment 7 in the conveyance direction N to the paper exit 9.

The conveyance belt 15 has a flat belt portion 15*a* extending horizontally over the top of the platen unit 11. The flat belt portion 15*a* defines the platen surface 11*a*. Pinch rollers 22 are pressed against the flat belt portion 15*a* from above at the front end and the back end of the flat belt portion 15*a*. The recording paper 3 is conveyed held between the pinch rollers 22 and the flat belt portion 15*a*.

A media supply mechanism 23 is disposed in the roll paper compartment 7. The media supply mechanism 23 includes a roll paper spindle 24 that holds the core 2*a* of the paper roll 2, and a supply motor (drive motor) 25 for rotating the roll paper spindle 24. The supply motor 25 is driven by PWM control, and drive power therefrom is transferred through a gear train 26 to the roll paper spindle 24. When the supply motor 25 is driven and the roll paper spindle 24 turns, the paper roll 2 mounted on the roll paper spindle 24 rotates in unison with the roll paper spindle 24. When the supply motor 25 drives forward, the recording paper 3 is delivered from the paper roll 2, and when the supply motor 25 drives in reverse, the recording paper 3 is rewound onto the paper roll 2.

A tension lever (movable member) 27 that can move following change in the tension on the recording paper 3 is disposed to the conveyance path 8 between the roll paper compartment 7 and the conveyance mechanism 12.

The tension lever 27 includes a lever portion 28 supported pivotably at the bottom end part around an axis of rotation O extending parallel to the width of the recording paper 3; and a roller portion 29 attached rotatably to the top end part of the lever portion 28. The lever portion 28 is urged to the back with a specific urging force by a compression spring (urging member) 30. More specifically, the tension lever 27 is urged by the compression spring 30 in the direction applying tension to the recording paper 3.

The recording paper 3 pulled up from the paper roll 2 stored in the roll paper compartment 7 travels around the roller portion 29, and continues to the front after curving to the front along the roller portion 29.

Note that instead of using a compression spring 30, a torsion spring may be disposed to the lever portion 28 at a position around the axis of rotation O so that the lever portion 28 is urged by the torsion spring in the direction moving the roller portion 29 to the back.

A rotary encoder (position detector) 31 that senses the current position of the tension lever 27 (lever portion 28) is disposed near the axis of rotation O of the lever portion 28. The rotary encoder 31 includes an encoder disc 32 that rotates in unison with the lever portion 28 around the axis of rotation O, and a detector 33 disposed at a fixed position opposite the outside edge of the encoder disc 32. The current position of the tension lever 27 is output from the detector 33.

As shown in FIG. 2, the tension lever 27 moves between a first position 27A where the lever portion 28 is urged to a position tilted to the back (the back of the printer), and a second position 27B where the lever portion 28 is nearly vertical.

A first stop member (not shown in the figure) that contacts the back of the tension lever 27 and limits displacement of the tension lever 27 to the back to the first position 27A is disposed on the back side of the first position 27A.

A second stop member (not shown in the figure) that contacts the front of the tension lever 27 and limits displacement of the tension lever 27 to the front is disposed in front of the second position 27B (the side toward the front of the printer).

Note that the second stop member contacts the tension lever 27 at a third position 27C where the tension lever 27 is displaced slightly forward from the second position 27B, and limits further forward displacement of the tension lever 27. The movement range of the tension lever 27 is therefore between the first position 27A and the third position 27C.

The printer 1 runs an initialization operation when the power turns on or a new paper roll 2 is loaded, for example. The initialization operation sequentially includes a slack removal operation that removes slack in the recording paper 3 between the paper roll 2 and the conveyance mechanism 12; a movement checking operation that checks whether or not movement of the tension lever 27 is obstructed; and a positioning operation that positions the tension lever 27 to a reference position 27D (set position, reference position). As shown in FIG. 2, the reference position 27D is midway between the first position 27A and second position 27B.

In the slack removal operation the tension lever 27 is moved from the first position 27A to a specific position toward the second position 27B by driving the supply motor 25 to turn the paper roll 2 and take up the recording paper 3 on the paper roll 2. This specific position is a position separated from the first position 27A slightly toward the second position 27B. In the movement checking operation, the tension lever 27 is set to the second position 27B by driving the supply motor 25 to turn the paper roll 2 and rewind the recording paper 3 onto the paper roll 2.

In the positioning operation, the tension lever 27 is set to the reference position 27D by driving the supply motor 25 to turn the paper roll 2 and deliver the recording paper 3 from the paper roll 2.

When the initialization operation ends, the printer 1 can run the printing process. In the printing process, the conveyance motor 21 is driven to convey the recording paper 3 by the conveyance mechanism 12 through the conveyance path 8 at a constant speed, and the printhead 5 is driven to print on the recording paper 3 as it passes the print position P. While the recording paper 3 is conveyed by the conveyance mechanism 12, the supply motor 25 is driven based on the current position of the tension lever 27 detected by the rotary encoder 31 to rewind the recording paper 3 onto the paper roll 2 or to deliver the recording paper 3 from the paper roll 2, and set the tension lever 27 to the reference position 27D. This suppresses fluctuation in the tension on the recording paper 3 and variation in the conveyance speed.

Control System

Figure 3:
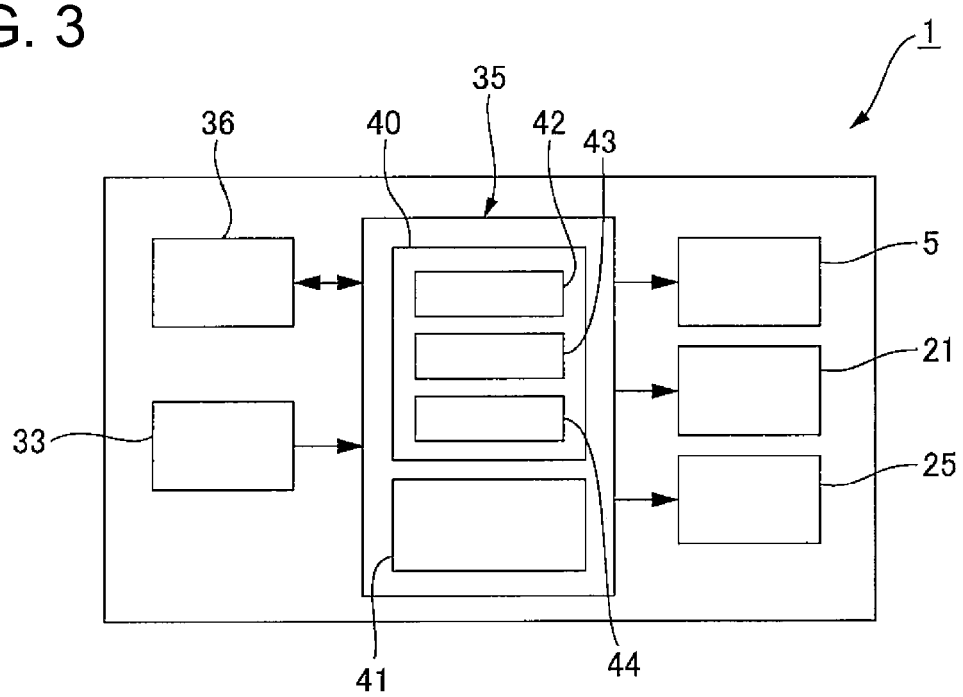
FIG. 3 is a basic block diagram of the control system of the printer shown in FIG. 1.

FIG. 3 is a block diagram showing main parts in the control system of the printer 1. The control system of the printer 1 is configured around a printer control unit 35 including a CPU and memory. A communication unit 36 that communicatively connects to an external device, and the detector 33 of the rotary encoder 31, are connected to the printer control unit 35. The printhead 5, conveyance motor 21, and supply motor 25 are connected through drivers not shown to the output side of the printer control unit 35. The printer control unit 35 also includes an initialization control unit 40 that controls the initialization operation, and a print control unit 41 that controls the printing process operation. The initialization control unit 40 includes a slack removal control unit 42, a movement checking control unit 43, and a positioning control unit 44.

The slack removal control unit 42 previously sets a slack removal target position between the first position 27A and the second position 27B. The slack removal control unit 42 also regularly acquires the current position of the roll paper compartment 7 detected by the rotary encoder 31. Each time the current position is acquired, the slack removal control unit 42 calculates the deviation (difference distance) between the current position and the slack removal target position, and applies PID control to the supply motor 25 to reduce this positioning deviation. As a result, the slack removal control unit 42 moves the tension lever 27 to a specific position closer to the second position 27B than the first position 27A.

In this example, the slack removal control unit 42 sets the reference position 27D to the slack removal target position. The supply motor 25 is therefore driven to move the tension lever 27 to the reference position 27D. When the tension lever 27 moves slightly from the first position 27A to the second position 27B, the slack removal control unit 42 stops driving the supply motor 25 and ends the slack removal operation (rewinding the recording paper 3). Note that the tension lever 27 moves from the first position 27A to the second position 27B side when slack in the recording paper 3 is removed between the conveyance mechanism 12 and the paper roll 2.

When the slack removal operation ends, the movement checking control unit 43 drives the supply motor 25 based on the current position of the tension lever 27 to rewind the recording paper 3 onto the paper roll 2 until the tension lever 27 reaches the second position 27B. More specifically, the movement checking control unit 43 executes a target positioning operation (first positioning operation) three times. This operation includes setting a position between the current position of the tension lever 27 and the second position 27B as a target position (first target position), and then driving the supply motor 25 based on the target position and the current position to set the tension lever 27 to the target position. Next, the movement checking control unit 43 executes a second positioning operation that sets the second position 27B as the target position (second target position) and drives the supply motor 25 based on the target position and the current position to reach the new target position (second position 27B).

In the target positioning operation (first positioning operation) and second positioning operation, the movement checking control unit 43 acquires the current position of the tension lever 27 detected by the detector 33 at a regular interval. Each time the current position is acquired, the movement checking control unit 43 calculates the deviation (difference distance) between the current position and the target position, and PID controls the supply motor 25 to reduce this positional deviation. As a result, the movement checking control unit 43 moves the tension lever 27 to the target position.

As shown in FIG. 2, the movement checking control unit 43 in this example executes the first target positioning operation using a first middle position 27E between the first position 27A and the reference position 27D as the target position. When the tension lever 27 reaches the first middle position 27E, the movement checking control unit 43 sets the reference position 27D as the target position and executes the target positioning operation a second time. When the tension lever 27 reaches the reference position 27D, the movement checking control unit 43 sets the second middle position 27F between the reference position 27D and the second position 27B as the target position, and executes the target positioning operation a third time. When the tension lever 27 reaches the second middle position 27F in the third target positioning operation, the movement checking control unit 43 executes the second positioning operation to bring the tension lever 27 to the second position 27B.

The slack removal control unit 42 drives the supply motor 25 in a first operating mode. The movement checking control unit 43 drives the supply motor 25 in a second operating mode with greater output (such as torque) than the first operating mode. When the supply motor 25 is driven in the second operating mode, the recording paper 3 can be rewound onto the paper roll 2 and the tension lever 27 moved to the second position 27B in resistance to the urging force of the compression spring 30. When the supply motor 25 is driven in the first operating mode, the output torque of the supply motor 25 is less than when the supply motor 25 is driven in the second operating mode. Therefore, the tension lever 27 therefore cannot go to the second position 27B in resistance to the urging force of the compression spring 30 when the recording paper 3 is rewound onto the paper roll 2 in the recording paper 3 slack removal operation of the slack removal control unit 42.

When the movement checking operation ends, the positioning control unit 44 drives the supply motor 25 based on the current position of the tension lever 27 to deliver recording paper 3 from the paper roll 2 and set the tension lever 27 to the reference position 27D. More specifically, the positioning control unit 44 sets the reference position 27D as the target position of the tension lever 27. The positioning control unit 44 acquires the current position of the tension lever 27 detected by the detector 33 at a regular interval. Each time the current position is acquired, the positioning control unit 44 calculates the deviation (difference distance) between the current position and the target position, and applies PID control to the supply motor 25 to reduce this deviation between the positions. As a result, the positioning control unit 44 moves the tension lever 27 to the target position (reference position 27D).

When the tension lever 27 is set to the second position 27B by the movement checking operation, the print control unit 41 checks based on the current position of the tension lever 27 is movement of the tension lever 27 is obstructed. If print data is received from an external device through the communication unit 36 after confirming that movement of the tension lever 27 is not obstructed, the print control unit 41 executes the printing process operation.

In the printing process operation, the print control unit 41 drives the conveyance motor 21 to convey the recording paper 3 by the conveyance mechanism 12 through the conveyance path 8 at a constant speed, and drives the printhead 5 to print on the recording paper 3 as it passes the print position P. While the recording paper 3 is conveyed by the conveyance mechanism 12, the print control unit 41 drives the supply motor 25 based on the current position of the tension lever 27 to rewind the recording paper 3 onto the paper roll 2 or deliver recording paper 3 from the paper roll 2. As a result, the print control unit 41 holds the tension lever 27 at the reference position 27D, suppresses variation in the tension on the recording paper 3, and suppresses fluctuation in the media conveyance speed resulting from variation in the tension.

To drive the supply motor 25 in the printing process operation, the print control unit 41 acquires the current position of the tension lever 27 detected by the detector 33 at a regular interval. Each time the current position is acquired, the print control unit 41 calculates the deviation (difference distance) between the current position and the target position, and applies PID control to the supply motor 25 to reduce this positioning deviation and hold the tension lever 27 at the reference position 27D. Note that the print control unit 41 drives the supply motor 25 in the second operating mode in the same way as the movement checking control unit 43.

Initialization Operation

Figure 4:
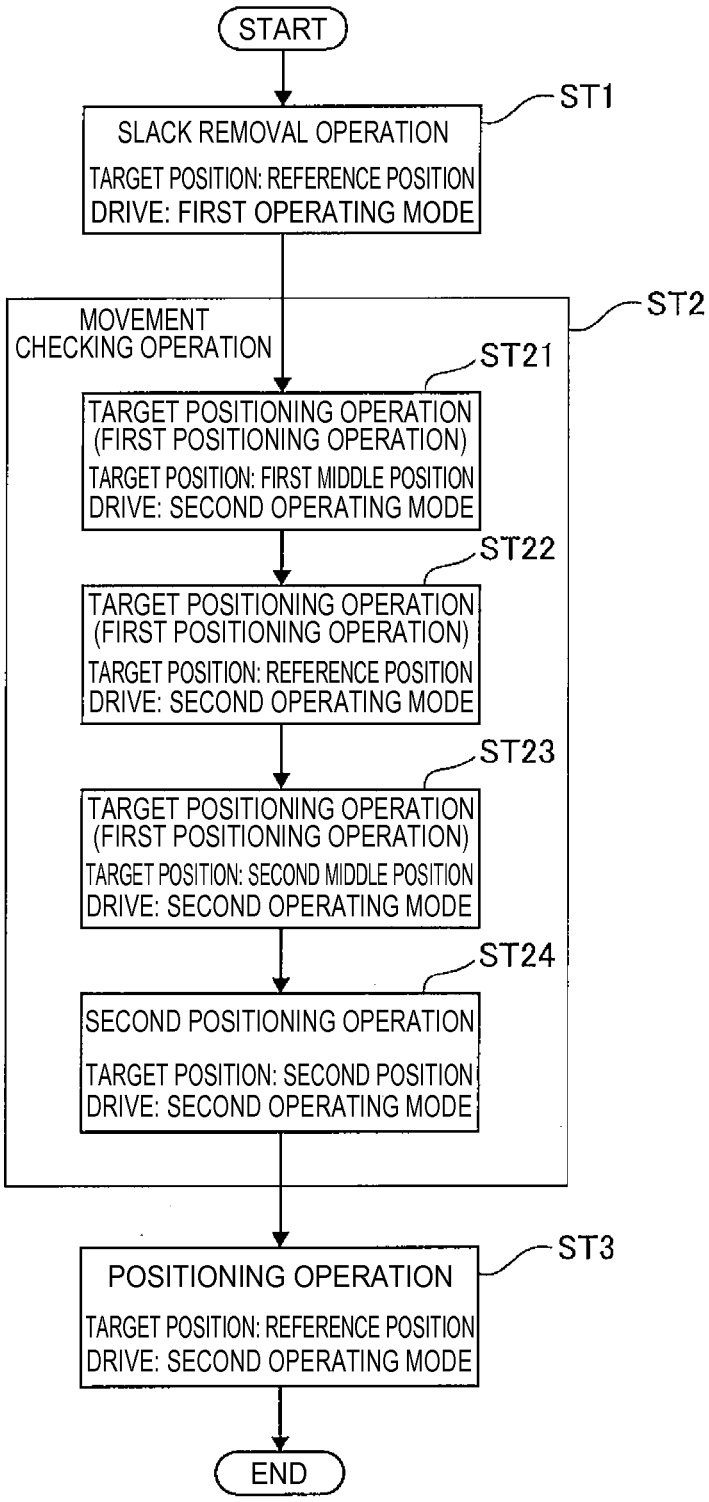
FIG. 4 is a flow chart of the initialization operation.
Figure 5A:
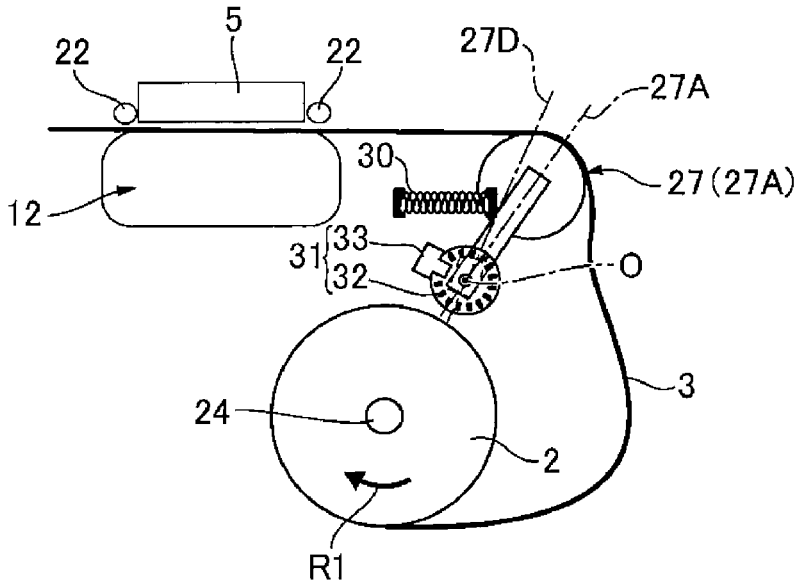
FIG. 5A illustrates the slack removal operation in the initialization operation.

The initialization operation is described below with reference to FIG. 4 to FIG. 7. FIG. 4 is a flow chart of the initialization operation of the printer 1. FIG. 5 illustrates the slack removal operation. FIG. 6 illustrates the movement checking operation. FIG. 7 illustrates the positioning operation.

Figure 5B:
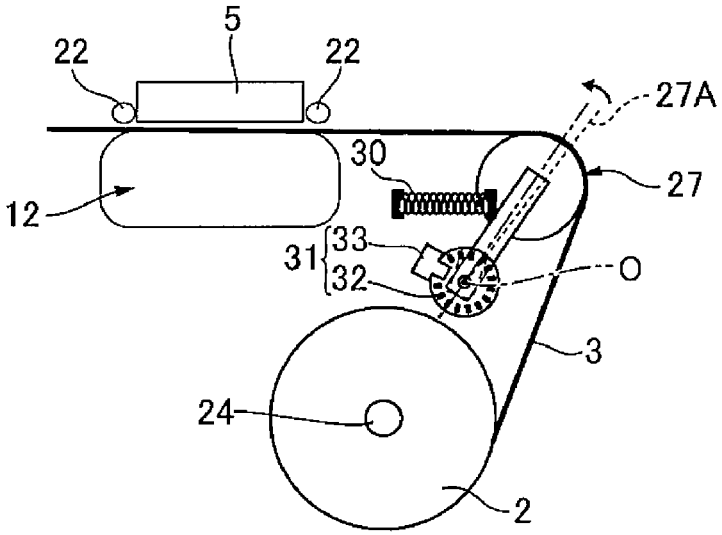
FIG. 5B illustrates the slack removal step of the initialization operation.

In the initialization operation, the printer 1 first executes the slack removal operation (slack removal process; step ST1). In the slack removal operation, the reference position 27D is set as the slack removal target position, and the supply motor 25 is PID controlled based on the difference between the current position of the tension lever 27 and the slack removal target position. During PID control the supply motor 25 is driven in a first operating mode with low output. As a result, the paper roll 2, as shown in FIG. 5B, rotates in the recording paper 3 rewinding direction R1. The recording paper 3 is therefore taken up onto the paper roll 2.

When the tension lever 27 is then detected to have moved from the first position 27A to a specific position toward the second position 27B based on the current position detected by the rotary encoder 31, driving the supply motor 25 stops. When the tension lever 27 has moved to a specific position from the first position 27A is when slack is removed from the recording paper 3 as shown in FIG. 5B.

In step ST1, the supply motor 25 is driven in the low output first operating mode, driving the supply motor 25 in the first operating mode stops when the tension lever 27 has moved from the first position 27A to the second position 27B side, and the slack removal operation ends. Excessively rewinding the recording paper 3 onto the paper roll 2 can therefore be suppressed even when there is very little slack in the recording paper 3 when the initialization operation starts. The recording paper 3 being pulled from the conveyance mechanism 12 to the paper roll 2 side and the conveyance mechanism 12 becoming unable to convey the recording paper 3 can therefore be avoided. In addition, the tension lever 27 moving abruptly toward the second position 27B, and colliding and making noise with the second stop that limits the range of tension lever 27 movement on the second position 27B side can also be prevented.

When the supply motor 25 is driven in the first operating mode, the tension lever 27 cannot move to the second position 27B in resistance to the urging force of the compression spring 30. Noise resulting from the tension lever 27 colliding with the second stop that limits the range of tension lever 27 movement on the second position 27B side can therefore be reliably prevented in the slack removal operation.

In the slack removal operation, the reference position 27D is set as the slack removal target position, and the supply motor 25 is PID controlled based on the difference between the slack removal target position and the current position of the tension lever 27. Therefore when the supply motor 25 is driven by PID control in the low output first operating mode to rotate the paper roll 2 in the slack removal operation, the tension lever 27 can be moved from the first position 27A toward the second position 27B against the urging force of the compression spring 30.

When the slack removal operation ends, the printer 1 executes the movement checking operation (movement checking process; step ST2). In the movement checking operation, the printer 1 executes the target positioning operation (first positioning operation) three times, and then executes the second positioning operation.

Figure 6A:
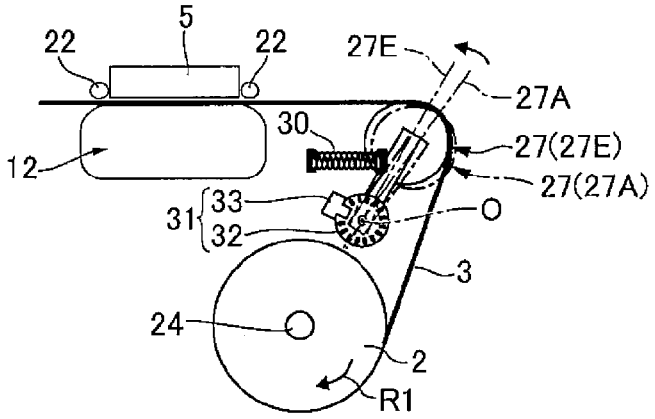
FIG. 6A illustrates the operation checking movement of the movable member in the initialization operation.

In the first target positioning operation, the first middle position 27E is set as the target position, and the supply motor 25 is PID controlled based on the difference between the current position of the tension lever 27 and the target position (the first middle position 27E in this instance). The supply motor 25 is then driven in the second operating mode with greater output than in the first operating mode (step ST21). As a result, as shown in FIG. 6A, the paper roll 2 turns in the rewinding direction R1 of the recording paper 3, the recording paper 3 is taken up onto the paper roll 2, and the tension lever 27 is set to the first middle position 27E.

Figure 6B:
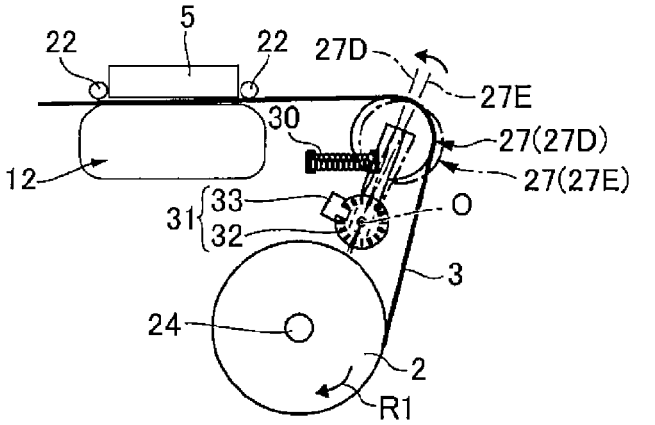
FIG. 6B illustrates the operation checking movement of the movable member in the initialization operation.

In the second target positioning operation, the reference position 27D is set as the target position, and the supply motor 25 is PID controlled based on the difference between the current position of the tension lever 27 and the target position (the reference position 27D in this instance). The supply motor 25 is driven in the second operating mode (step ST22). As a result, as shown in FIG. 6B, the paper roll 2 turns in the rewinding direction R1 of the recording paper 3, the recording paper 3 is taken up onto the paper roll 2, and the tension lever 27 is set to the reference position 27D.

Figure 6C:
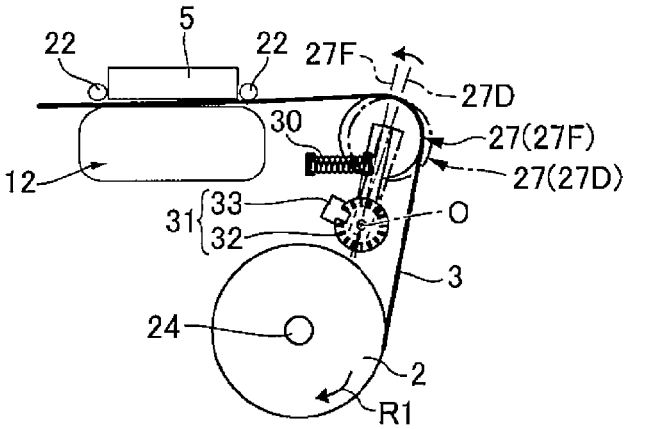
FIG. 6C illustrates the operation checking movement of the movable member in the initialization operation.

In the third target positioning operation, the second middle position 27F is set as the target position, and the supply motor 25 is PID controlled based on the difference between the current position of the tension lever 27 and the target position (the second middle position 27F in this instance). The supply motor 25 is driven in the second operating mode (step ST23). As a result, as shown in FIG. 6C, the paper roll 2 turns in the rewinding direction R1 of the recording paper 3, the recording paper 3 is taken up onto the paper roll 2, and the tension lever 27 is set to the second middle position 27F.

Figure 6D:
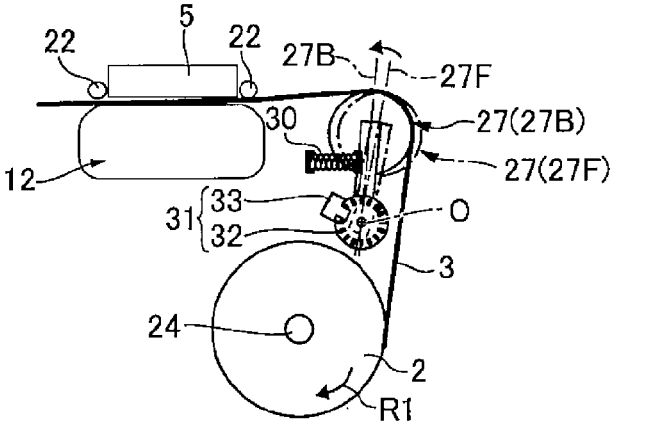
FIG. 6D illustrates the operation checking movement of the movable member in the initialization operation.

In the second positioning operation, the second position 27B is set as the target position, and the supply motor 25 is PID controlled based on the difference between the current position of the tension lever 27 and the target position (the second position 27B in this instance). The supply motor 25 is driven in the second operating mode (step ST24). As a result, as shown in FIG. 6D, the paper roll 2 turns in the rewinding direction R1 of the recording paper 3, the recording paper 3 is taken up onto the paper roll 2, and the tension lever 27 is set to the second position 27B.

The print control unit 41 knows from the tension lever 27 going to the second position 27B that movement of the tension lever 27 is not obstructed. Note that if the tension lever 27 does not reach the second position 27B, the printer control unit 35 determines an error has occurred and stops driving the supply motor 25.

In step ST2, the tension lever 27 is moved in stages while changing the target position. The speed of tension lever 27 movement can therefore be controlled even when the supply motor 25 is driven in the high output second operating mode. The tension lever 27 can therefore be accurately set to the second position 27B, and the tension lever 27 colliding with the second stop and producing noise can be prevented. Furthermore, because the speed of tension lever 27 movement is suppressed, the recording paper 3 will not become trapped between the second stop and the tension lever 27 moving toward the second position 27B.

Figure 7A:
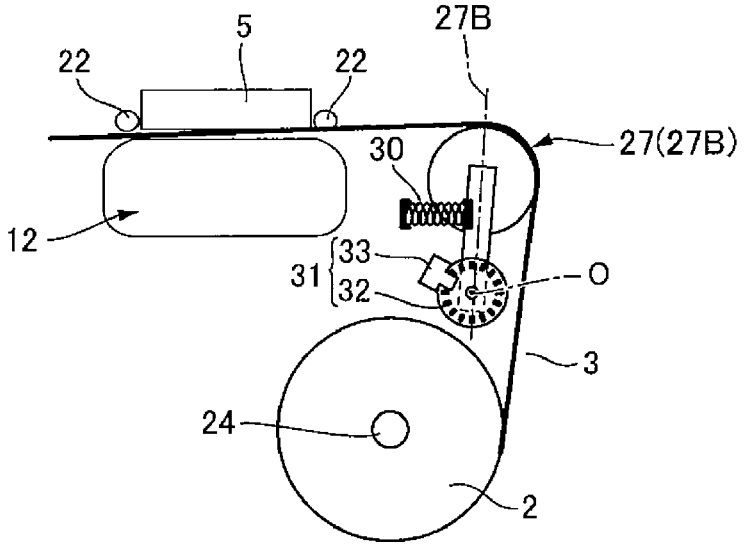
FIG. 7A illustrates the positioning operation in the initialization operation.

When the movement checking operation ends, the tension lever 27 is set to the second position 27B as shown in FIG. 7A. When the tension lever 27 is at the second position 27B, the printer 1 executes the positioning operation (positioning process; step ST3).

Figure 7B:
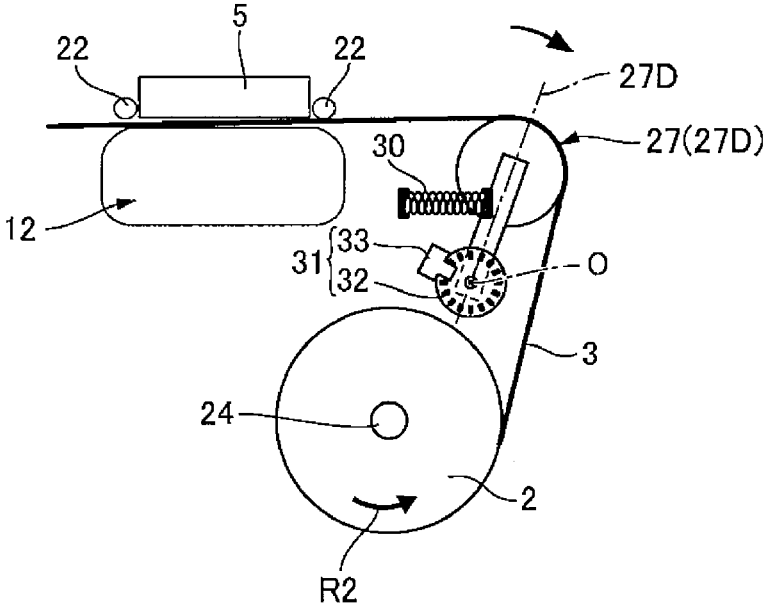
FIG. 7B illustrates the positioning operation in the initialization operation.

In the positioning operation, the reference position 27D is set as the target position, and the supply motor 25 is PID controlled based on the difference between the current position of the tension lever 27 and the target position (the reference position 27D in this instance). The supply motor 25 is driven in the second operating mode. As a result, as shown in FIG. 7B, the paper roll 2 turns in the delivery direction R2 opposite the rewinding direction R1, the recording paper 3 is delivered from the paper roll 2, and the tension lever 27 is held at the reference position 27D.

Printing Process Operation

When the initialization operation ends, the printer 1 can execute the printing process. In the printing process, the conveyance motor 21 is driven and the recording paper 3 is conveyed at a constant speed by the conveyance mechanism 12. The printhead 5 is also driven to print on the recording paper 3 as it passes the print position P. The supply motor 25 is also driven while driving the conveyance motor 21.

When driving the supply motor 25 in the printing process operation, the reference position 27D is set as the target position, and the supply motor 25 is PID controlled based on the difference between the current position of the tension lever 27 and the target position (the reference position 27D in this instance). The supply motor 25 is driven in the second operating mode. As a result, the recording paper 3 is rewound onto the paper roll 2 and the recording paper 3 is delivered from the paper roll 2, the tension lever 27 is held at the reference position 27D, and variation in tension on the recording paper 3 is suppressed.

In this embodiment of the invention the slack removal operation is executed in the initialization operation before the printing process executes. The tension on the recording paper 3 fluctuating greatly when the conveyance operation starts and the conveyance speed becoming unstable can therefore be prevented.

A movement checking operation is also executed in the initialization operation. The ability to normally control driving the supply motor 25 based on the current position of the tension lever 27 during the printing process to suppress variation in the tension on the recording paper 3 can therefore be assured.

A positioning operation that sets the tension lever 27 to the reference position 27D is also executed during the initialization operation. Therefore, when the printing process is executed continuously to the initialization operation, controlling driving the supply motor 25 and suppressing variation in the tension on the recording paper 3 can start without delay.

The disclosure being thus described, it will be obvious that it may be varied in many ways. Such variations are not to be regarded as a departure from the spirit and scope of the disclosure, and all such modifications as would be apparent to one skilled in the art are intended to be included within the scope of the following claims.

What is claimed is:

1. A media conveyance device configured to convey a media delivered from a paper roll through a conveyance path comprising:

a drive motor configured to rotate the paper roll;

a pinch roller configured to be in contact with the media;

a movable member configured to move between a first position and second position different from the first position based on a tension on the media, and disposed on the conveyance path between the paper roll and the pinch roller;

a position detector configured to detect a current position of the movable member; and a control unit, wherein the control unit drives the drive motor in a first operating mode and rewinds the media onto the paper roll until the movable member moves from the first position to a specific position toward the second position, and the control unit drives the drive motor in a second operating mode with greater output than in the first operating mode, rewinds the media onto the paper roll based on the current position of the movable member, and moves the movable member from the specific position to the second position.

2. The media conveyance device described in claim 1 further comprising:

an urging member configured to urge the movable member from the second position toward the first position with an urging force.

3. The media conveyance device described in claim 2, wherein:

the urging member does not move the movable member to the second position in resistance to the urging force when the drive motor is driven in the first operating mode.

4. The media conveyance device described in claim 1, wherein:

the control unit drives the drive motor based on the current position and a first target position which is between the current position and the second position, and moves the movable member to the first target position, and drives the drive motor based on the current position and the second position, and moves the movable member to the second position.

5. The media conveyance device described in claim 4, wherein:

the control unit uses PID to control the drive motor based on a difference between the current position and the first target position.

6. The media conveyance device described in claim 4, wherein:

the control unit uses PID to control the drive motor based on a difference between the current position and the second position.

7. The media conveyance device described in claim 1, wherein:

the control unit drives the drive motor in a first operating mode based on the current position and a predetermined position between the specific position and the second position, and moves the movable member from the first position.

8. The media conveyance device described in claim 1, wherein:

when the movable member reaches the second position, the control unit drives the drive motor, and causes the media to go slack, and sets the movable member to a target position between the first position and the second position.

9. A printer configured to print a media delivered from a paper roll through a conveyance path comprising:

a printhead;

a drive motor configured to rotate the paper roll;

a pinch roller configured to be in contact with the media;

a movable member configured to move between a first position and second position different from the first position based on a tension on the media, and disposed on the conveyance path between the paper roll and the pinch roller;

a position detector configured to detect a current position of the movable member; and a control unit, wherein the control unit drives the drive motor in a first operating mode and rewinds the media onto the paper roll until the movable member moves from the first position to a specific position toward the second position, and the control unit drives the drive motor in a second operating mode with greater output than in the first operating mode, rewinds the media onto the paper roll based on a current position of the media, and moves the movable member from the specific position to the second position.

10. The printer described in claim 9 further comprising:

an urging member configured to urge the movable member from the second position toward the first position.

11. The printer described in claim 9, wherein when the movable member reaches the second position, the control unit drives the drive motor, and causes the media to have slack, and sets the movable member to a target position between the first position and the second position, and when the movable member reaches the target position, the control unit starts to drive the printhead.

12. A control method of a printer configured to print a media delivered from a paper roll through a conveyance path including a printhead, a pinch roller configured to be in contact with the media, a drive motor configured to rotate the paper roll, and a movable member configured to move between a first position and second position different from the first position based on a tension on the media, and disposed to the conveyance path between the paper roll and the pinch roller, comprising;

driving the drive motor in a first operating mode and rewinds the media onto the paper roll until the movable member moves from the first position to a specific position toward the second position, and driving the drive motor in a second operating mode with greater output than in the first operating mode, rewinds the media onto the paper roll based on a current position of the media, and moves the movable member from the specific position to the second position.

* * * * *